United States Patent [19]

Inui et al.

[11] 4,388,158

[45] Jun. 14, 1983

[54] ACIDIC TINPLATING PROCESS AND PROCESS FOR PRODUCING AN IRON-TIN ALLOY ON THE SURFACE OF A STEEL SHEET

[75] Inventors: Tsuneo Inui, Tokuyama; Hitoshi Kuroda, Kudamatsu; Tetsuro Hanabusa, Kudamatsu; Katsuhito Yazaki, Kudamatsu, all of Japan

[73] Assignee: Toyo Kohan Company, Ltd., Tokyo, Japan

[21] Appl. No.: 277,162

[22] Filed: Jun. 25, 1981

Related U.S. Application Data

[63] Continuation-in-part of Ser. No. 92,752, Nov. 9, 1979, abandoned.

[30] Foreign Application Priority Data

Nov. 27, 1978 [JP] Japan ..... 53-145333

[51] Int. Cl.[3] ..... C25D 3/32; C25D 5/50; C25D 5/10

[52] U.S. Cl. ..... 204/27; 204/37 T; 204/40; 204/54 R

[58] Field of Search ..... 204/54 R, 43 S, 120, 204/123, 37 T, 40, 27

[56] References Cited

U.S. PATENT DOCUMENTS

| | | | |
|---|---|---|---|
| 1,987,749 | 1/1935 | Pine | 204/54 R |
| 2,930,740 | 3/1960 | Francisco et al. | 204/54 R |
| 3,082,157 | 3/1963 | Francisco et al. | 204/54 R |
| 3,616,292 | 10/1971 | Wilson | 204/54 R X |
| 4,113,580 | 9/1978 | Tsutsui et al. | 204/37 T |
| 4,145,263 | 3/1979 | Tsutsui et al. | 204/35 R |

FOREIGN PATENT DOCUMENTS

| | | | |
|---|---|---|---|
| 45-19362 | 7/1970 | Japan . | |
| 46-25603 | 7/1971 | Japan . | |
| 53-33942 | 9/1978 | Japan . | |
| 2037814 | 7/1980 | United Kingdom | 204/54 R |
| 190751 | 11/1965 | U.S.S.R. . | |
| 212687 | 2/1967 | U.S.S.R. . | |

*Primary Examiner*—G. L. Kaplan
*Attorney, Agent, or Firm*—Wenderoth, Lind & Ponack

[57] ABSTRACT

An acidic tinplating electrolyte containing at least one sulfate selected from the sulfates of alkaline metals, ammonium, aluminum, manganese or chromium and an ethoxylated $\alpha$-naphthol sulfonic acid in a known stannous sulfate or stannous phenolsulfonate electrolyte.

This acidic tinplating electrolyte is suitable as a preplating electrolyte for a tinplate in which excellent corrosion resistance is required and also as an electrolyte for the production of a steel sheet having an extremely thin tin layer or an extremely thin iron-tin alloy layer, as a very dense and uniform tin layer is formed on the steel sheet by using the electrolyte of this invention.

3 Claims, No Drawings

ACIDIC TINPLATING PROCESS AND PROCESS FOR PRODUCING AN IRON-TIN ALLOY ON THE SURFACE OF A STEEL SHEET

I. CROSS-REFERENCE TO RELATED APPLICATION

This is a continuation-in-part of U.S. application Ser. No. 92,752, filed Nov. 9, 1979 and now abandoned.

II. FIELD OF THE INVENTION

The present invention relates to an acidic tinplating electrolyte. In detail, the invention relates to a preplating electrolyte for tinplates in which excellent corrosion resistance is required and to an electrolyte for the production of a steel sheet having an extremely thin tin layer or an extremely thin iron-tin alloy ($FeSn_2$) layer.

III. DESCRIPTION OF THE PRIOR ART

Recently the change from expensive electrotinplates to cheaper tin free steel (TFS) consisting of metallic chromium and hydrated chromium oxide as well as a decrease in the weight of the tin coating in electrotinplates have rapidly taken place in the field of food cans. This is because the tin used for the production of tinplates is very expensive, and there is concern over the exhaustion of tin resources in the world.

An ordinary metal can consists of two pieces of can ends and one piece of a can body. The tinplate can body is usually seamed by soldering. In the soldering process, the appearance of the can body is deteriorated, because the metallic tin on the tinplate is remelted when heated above 232° C., which is the melting point of metallic tin. Other problems, such as the residue of flux or surface discoloration, are caused by the flux as used in the soldering process.

A method of seaming a tinplate can body by electric welding has also been proposed. In such electric welding process, however, the melt of the surface tin in the vicinity of the welded part remarkably detracts from the appearance of the can body.

Another method of seaming the tinplate can body by organic adhesives have likewise been proposed, for instance, in Laid-Open Japanese patent application No. Sho 49-37829 and Japanese Patent Publication No. Sho 48-18929. However, after a few months, the tinplate can body, seamed by an organic adhesive, may be broken, because the bonding strength in the seam is remarkably low.

In the case of TFS, the seaming of the can body is generally carried out with nylon adhesives by using the Toyo Seam and Mira Seam methods. The nylon adhered part of the lacquered TFS can body has not only an acceptable bonding strength in the normal state, but also a bonding strength which can satisfactorily withstand internal pressure caused by certain contents, such as beer and carbonated beverages.

However, when a TFS can body seamed by a nylon adhesive is used for foods such as fruit juices (which are immediately packed after pasteurization at temperature of 90°~100° C.), or coffee, meat and fish (which are pasteurized by hot steam at a temperature above 100° C. in a retort after being packed in the can at 90°~100° C.), the lacquer film may be peeled off from the TFS surface.

A method of seaming a TFS can body by electric welding has been well known. In this electric welding process, however, the seaming process is intricate because the metallic chromium layer and the hydrated chromium oxide layer must be mechanically or chemically removed from the TFS surface.

Furthermore, in the case of TFS used for food cans, there are some problems, such as formation of rust under the lacquer film, dissolution of iron by local corrosion in cracks in the lacquer film, and deterioration of the flavor of foodstuffs by iron pick-up during long storage in the formed parts of the TFS can, particularly the flange in the can body and the chuck wall radius in the can ends. Therefore, both expensive electrotinplates and cheap TFS are not satisfactory as materials for food cans.

Under the background as described above, a steel sheet having an extremely thin layer or an extremely thin iron-tin alloy ($FeSn_2$) layer, obtained by heating an extremely thin tin plated steel sheet has recently heen developed as a steel base for lacquering. Namely a steel sheet having an extremely thin tin layer comprises a duplex layer, the lower layer consisting of 0.05~0.60 $g/m^2$ of metallic tin and the upper layer consisting of hydrated chromium oxide containing 0.005~0.05 $g/m^2$ as chromium, whereas the steel sheet having an extremely thin iron-tin alloy layer comprises a duplex layer, the lower layer consisting mainly of an iron-tin alloy having 0.05~1.0 $g/m^2$ as tin and the upper layer consisting of hydrated chromium oxide containing 0.005~0.05 $g/m^2$ as chromium.

These treated steel sheets have various excellent characteristics in bonding strength by organic adhesives, lacquer adhesion, electric weldability and corrosion resistance in the formed parts to contents such as acidic beverages, vegetables, fish and meat.

In order to produce these steel sheets having an extremely thin tin layer and an extremely thin iron-tin alloy layer, a known tinplating electrolyte is used, namely an acidic electrolyte such as stannous sulfate, stannous phenol-sulfonate and stannous chloride, or an alkaline electrolyte such as sodium stannate and potassium stannate. However, it is very difficult to obtain both a dense tin layer and a dense iron-tin alloy layer formed by heating, because the current efficiency for tinplating in the known acidic electrolyte is so high, being over 90%, and moreover the formed tin layer is very thin.

In comparison with the known acid electrolytes, according to the electrolytic tinplating using the known alkaline electrolyte or the weakly acidic electrolyte having a low concentration of stannous ions, as described in Japanese Patent Publication No. Sho 46-25603, in which hydrogen gas is generated in a considerable amount during electrotinplating, a comparatively dense tin layer or a comparatively dense iron-tin alloy layer formed by heating can be obtained. However, a rectifier having a large capacity is necessary for electrotinplating because the electric resistance of the weakly acidic electrolyte having a low concentration of stannous ions, as described in Japanese Patent Publication No. Sho 46-25603, is high and the bath voltage is high. Therefore tinplating using a weakly acidic electrolyte having a low concentration of stannous ions is economically disadvantageous.

Furthermore, the known alkaline electrolytes in which the current efficiency for tinplating under the high current density is remarkably low is not suitable for tinplating at high speed.

IV. SUMMARY OF THE INVENTION

It is the first object of the present invention to provide a steel sheet having an extremely thin tin layer or an extremely thin iron-tin alloy layer having excellent bonding strength after aging in hot water, without the deterioration of various characteristics such as the bonding strength of the organic adhesives, the lacquer adhesion, the electric weldability as well as the corrosion resistance after forming. This is achieved by using a tinplating electrolyte in which a selected compound is added to the known acidic electrolyte.

It is a second object of the present invention to prepare an electrolyte which is suitable for the continuous and stable production of an extremely thin tin-plated steel sheet.

The acidic electro-tinplating electrolyte according to the present invention is characterized by the addition of at least one sulfate selected from the group consisting of sulfates of alkaline metals, ammonium, aluminum, manganese and chromium into the known acidic electrolyte which contains mainly stannous phenolsulfonate or stannous sulfate. Though it is considered that chlorides, fluorides, or nitrates in addition to the sulfates may be added to the stannous phenolsulfonate or stannous sulfate electrolyte, these anions are not preferable, as the denseness of the formed tin layer is lowered.

The reason why a thin, uniform and dense tin layer may be formed on the steel sheet by thin tinplating when using the electrolyte according to the present invention is as follows:

In the present invention, the sulfate which is added into the acidic tinplating electrolyte acts as a polarizer and accelerates the generation of hydrogen gas during electrotinplating, so that the surface of the steel sheet to be plated with tin is activated because iron oxide on the steel sheet is reduced by the generated hydrogen gas. So, the activated surface of the steel sheet is immediately plated with tin.

Therefore, a steel sheet having an extremely thin tin layer or an extremely thin iron-tin alloy layer obtained by using the electrolyte according to the present invention, which has various excellent characteristics of bonding strength, especially bonding strength after aging in hot water, lacquer adhesion and corrosion resistance after forming, can be used to manufacture cans for carbonated beverages and acidic beverages. The method can also be used to produce two-piece cans, such as oval cans and drawn and redrawn cans.

The thin tin plated steel sheet obtained by the electrolyte according to the present invention has excellent electric weldability and can be easily used for welded cans without the mechanical removal of the surface film as in TFS.

The acidic tinplating electrolyte according to the present invention is more suitable as an electrolyte for subjecting the steel sheet to flash tinplating before the conventional tinplating step. This flash tinplating step is well known as a production method of tinplating in which excellent corrosion resistance is required. The inventive electrolyte, however, is not suitable as an electrolyte for the production of conventional electrotinplates, because of the low current efficiency in the tinplating step.

V. DETAILED DESCRIPTION OF THE INVENTION

In the present invention, at least one sulfate selected from the group consisting of the sulfates of alkaline metals, ammonium, aluminum, manganese and chromium is added to the known stannous sulfate or stannous phenolsulfonate electrolytes.

The conditions of electrotinplating for the industrial production of a steel sheet having an extremely thin tin layer or an extremely thin iron-tin alloy layer and flash tinplating are broadly defined as follows:

Concentration of stannous ions: 1.5~50 g/l
Concentration of acid (as $H_2SO_4$): 1.0~30 g/l
Weight ratio of stannous ions to acid: 1~3
Concentration of sulfate: 5~150 g/l
Temperature of the electrolyte: 25°~60° C.
Current density: 5~50 A/dm$^2$ In a most typical electrotinplating step conventionally used, the tinplating is performed in an aqueous electrolyte consisting of the following concentrations: 15–50 g/l of stannous ions, 10–30 g/l of sulfuric acid or 36–106.5 g/l phenolsulfonic acid and 3–10 g/l of a surface active agent at a temperature of 25° to 60° C. and under a cathodic current density of 5–50 A/dm$^2$.

In this case the lower limit in the amount of stannous ions, sulfuric acid and phenolsulfonic acid is raised up to 15 g/l, 10 g/l and 36 g/l, respectively, in order to maintain high current efficiency for the electrodeposition of tin.

Applicants differentiate from this conventional electroplating electrolyte composition primarily by the addition of the alkaline sulfate, etc., mentioned above, as well as the addition of an ethoxylated $\alpha$-naphthol sulfonic acid component to achieve optimum results.

In regard to the above, it is generally understood that the amount of acid in a stannous phenolsulfonate electrolyte or a stannous sulfate electrolyte used for industrial electrotinplating is expressed as the amount of sulfuric acid, as described at Table 8.1 on page 227 in "Technology of Tinplate" by W. E. Hoare et al.

Each phenolsulfonic acid and sulfuric acid molecule is dissociated as follows in the electrolyte:

Dissociation of phenolsulfonic acid $$C_6H_4(OH)SO_3H \rightarrow C_6H_4(OH)SO_3^- + H^+$$

Dissociation of sulfuric acid $$H_2SO_4 \rightarrow SO_4^{-2} + 2H^+$$

1 mole of $H^+$ is liberated from 1 mole of phenolsulfonic acid (molecular weight 174) and 2 moles of $H^+$ are liberated from 1 mole of sulfuric acid (molecular weight 98). Namely 2 moles of phenolsulfonic acid correspond to 1 mole of sulfuric acid. Thus, the range of 1.0–30 g/l of sulfuric acid as used in the present application and claims corresponds to $174 \times 2/98$–$174 \times 2 \times 30/98$ g/l; that is about 3.6–106.5 g/l, of phenolsulfonic acid.

The ratio of stannous ions to the sulfuric acid or phenolsulfonic acid component is 1–3:1 or 1–3:3.6, respectively.

Generally, a lower current density is applied for the formation of a dense tin layer at lower temperatures of the electrolyte, for lower concentration of the stannous ions and for a higher concentration of the acid. On the contrary, when higher temperatures are employed and a higher concentration of stannous ions as well as a lower concentration of acid is used, a higher current density must be applied.

In the present invention, it is desirable that the amount of the sulfates of alkali metals, ammonium, aluminum, manganese and the chromium added to the known tinplating electrolyte is at least above 5 g/l. If the added sulfate is below 5 g/l, it is impossible to improve the uniformity and the denseness of the plated tin layer. The upper limit in the amount of the added sulfate is not critical and it is unnecessary to positively limit it because the uniformity and the denseness of the plated tin layer is improved, even if the amount of the added sulfate is above its solubility. However, in such a case, the insoluble powder of the added sulfate which is caught between the steel strip and the conductor rolls or the sink rolls during the continuous electrotinplating of a cold rolled steel strip causes surface stains. Therefore the addition of the sulfate over this solubility is not recommended in order to carry out the plating on an industrial plane and in a stable manner.

Especially, in the case of an electrolyte with a low concentration of stannous ions, although the electric resistance of the electrolyte decreases with an increase in the addition of sulfate as described above, an excessive addition of sulfate results in only a slight decrease in the electric resistance of the electrolyte. Furthermore, from the standpoint of the exhaustion of the tin resources, the upper limit in the amount of the added sulfate should be restricted to 150 g/l as sulfate.

Instead of the sulfates, it is possible to add a hydroxide or an oxide of alkaline metals, ammonium, aluminum, manganese and chromium, along with sulfuric acid, which is equivalent to the addition of the sulfates.

One critical feature of the present invention is the use of the ethoxylated α-naphthol sulfonic acid component therein in conjunction with said sulfate. By the use of this combination, a steel sheet covered with a thin and dense tin layer having excellent corrosion resistance, weldability and lacquer adhesion after aging in hot water can be obtained. The ethoxylated α-naphthol sulfuric acid component usually has about between 3 to 7 ethoxy groups in its structure.

While the acidic tinplating electrolyte may be used for the electrotinplating of a cold rolled steel strip for a period of time, a considerable amount of a ferrous ion is inevitably formed in the electrolyte. The formed ferrous ion, however, does not have a bad effect on the electrolyte according to the present invention. The existence of the ferrous ion is actually preferred because it acts as the polarizer in the electrolyte and improves the denseness of the plated tin layer according to the present invention.

Although a part of the manganese ion and trivalent chromium ion which is added as a sulfate may be occasionally codeposited with the stannous ions, it does not deleteriously interfere with the formation of the dense tin layer, which is an object of the present invention.

In the present invention, the temperature of the electrolyte and the current density conditions are the same as in a conventional tinplating operation by using the known stannous sulfate electrolyte or stannous phenolsulfonate electrolyte.

It should be emphasized that the electrolyte according to the present invention is not used as a conventional tinplating electrolyte because of the low current efficiency thereof. This is because the addition of the sulfate, according to the present invention, decreases the current efficiency of the tinplating.

According to the present invention the tin-plated steel may be subsequently subjected to a heating step at a temperature of 232°–400° C. for 0.5–10 seconds.

The basic electrolyte composition of the present invention, however, can be used in a conventional tinplating step, providing the sulfate is not added. A typical electrolyte used in a conventional tinplating step for example, has the following composition:

Stannous ion: 20–50 g/l
Acid ($H_2SO_4$): 10–25 g/l
Ferric ion: below 20 g/l

The present invention is illustrated by the following examples.

EXAMPLE 1

A cold rolled steel sheet having a thickness of 0.23 mm was electrolytically degreased in a solution of sodium hydroxide and then pickled in dilute sulfuric acid. The steel sheet, after being rinsed with water, was electroplated with tin under the following plating conditions:

Composition of the electrolyte:
Stannous sulfate: 40 g/l
Phenolsulfonic acid (60% aqueous solution): 25 g/l
Ethoxylated α-naphthol sulfonic acid: 3 g/l
Aluminum sulfate: 50 g/l
Temperature of electrolyte: 45° C.
Cathodic current density: 10 A/dm$^2$ After rinsing with water and drying, the tin plated steel sheet was cathodically treated under the following conditions and was then rinsed with water, dried and coated with a thin film of dioctyl sebacate (DOS) by the ordinary method used in an electrotinplating process.

Composition of electrolyte
Sodium dichromate: 30 g/l
Temperature of electrolyte: 45° C.
Cathodic current density: 15 A/dm$^2$

EXAMPLE 2

A steel sheet was pretreated and electrotinplated as in Example 1. The tin plated steel sheet was then rinsed with water and dried. The tinplated steel sheet, before the electrolytic chromic acid treatment as in Example 1, was maintained at 232°–260° C. for 2 seconds by resistance heating and then was immediately quenched and dried. After the electrolytic chromic acid treatment, the treated steel sheet was rinsed with water, dried and coated with a thin film of DOS as in Example 1.

EXAMPLE 3

A steel sheet pretreated as in Example 1 was plated with tin as outlined below. After rinsing with water, the tin plated steel sheet was subjected to an electrolytic chromic acid treatment under the conditions also outlined below:

Conditions of electrotinplating

Composition of electrolyte:
Stannous sulfate: 25 g/l
Phenolsulfonic acid (60% aqueous solution): 15 g/l
Ethoxylated α-naphthol sulfonic acid: 2 g/l
Manganese sulfate: 10 g/l
Temperature of electrolyte: 50° C.
Cathodic current density: 20 A/dm$^2$ Conditions of electrolytic chromic acid treatment Composition of electrolyte:
Chromic acid: 30 g/l
Sodium hydroxide: 10 g/l
Temperature of electrolyte: 40° C.
Cathodic current density: 10 A/dm$^2$ After rinsing with water and drying, DOS was coated thereon in the same manner as mentioned in Example 1.

EXAMPLE 4

A steel sheet was pretreated and electrotinplated as in Example 3, and was then rinsed with water and dried. The tin plated steel sheet was maintained at 232°~260° C. for 1.5 seconds by resistance heating and was then quenched. The steel sheet thus-covered with iron-tin alloy was treated under the same conditions as in Example 3. After rinsing with water and drying, DOS was coated thereon in the same manner as mentioned in Example 1.

EXAMPLE 5

A steel sheet pretreated as in Example 1 was plated with tin under the conditions outlined below. After rinsing with water, the tin plated steel sheet was then subjected to an electrolytic chromic acid treatment under the conditions also set forth below.

Conditions of electrotinplating

Composition of electrolyte:
Stannous sulfate: 20 g/l
Phenolsulfonic acid (60% aqueous solution): 10 g/l
Ethoxylated α-naphthol sulfonic acid: 1 g/l
Chromium sulfate: 5 g/l
Temperature of electrolyte: 45° C.
Cathodic current density: 15 A/dm$^2$ Conditions of electrolytic chromic acid treatment Composition of electrolyte:
Chromic acid: 50 g/l
Sulfuric acid: 0.3 g/l
Fluoboric acid: 0.3 g/l
Temperature of electrolyte: 40° C.
Cathodic current density: 3 A/dm$^2$ After rinsing with water and drying, DOS was coated thereon in the same manner as mentioned in Example 1.

EXAMPLE 6

A steel sheet was pretreated and electrotinplated as in Example 5, and was then rinsed with water and dried. The tin plated steel sheet was maintained at 232°~260° C. for 3 seconds by resistance heating and was then quenched. The steel sheet thus-covered with an iron-tin alloy was treated under the same conditions as in Example 5. After rinsing with water and drying, DOS was coated thereon in the same manner as mentioned in Example 1.

COMPARATIVE EXAMPLE 1

A steel sheet pretreated as in Example 1 was plated with tin under the conditions set forth below.

Conditions of electrotinplating

Composition of electrolyte:
Stannous sulfate: 40 g/l
Phenolsulfonic acid (60% aqueous solution): 25 g/l
Ethoxylated α-naphthol sulfonic acid: 3 g/l
Temperature of electrolyte: 45° C.
Cathodic density: 10 A/dm$^2$ After rinsing with water, the tin plated steel sheet was subjected to an electrolytic chromic acid treatment by using 30 g/l of a sodium dichromate solution under 15 A/dm$^2$ at an electrolyte temperature of 45° C. After rinsing with water and drying, DOS was coated thereon in the same manner as mentioned in Example 1.

COMPARATIVE EXAMPLE 2

A steel sheet was pretreated and electrotinplated as in Comparative Example 1, and was then rinsed with water and dried. The tin plated steel sheet was flow melted by using ordinary resistance heating as in an electrotinplating process, and then was cathodically treated under the same conditions as in Comparative Example 1. After rinsing with water and drying, DOS was coated thereon in the same manner as mentioned in Example 1.

COMPARATIVE EXAMPLE 3

A steel sheet pretreated as in Example 1 was subjected to an electrolytic chromic acid treatment under the following conditions:

Composition of electrolyte:
Chromic acid: 80 g/l
Sulfuric acid: 0.3 g/l
Fluoboric acid: 0.6 g/l
Temperature of electrolyte: 55° C.
Cathodic current density: 20 A/dm$^2$ After rinsing with water and drying, DOS was coated thereon in the same manner as mentioned in Example 1.

The characteristics of the resultant steel sheet were evaluated by the following test methods, after the measurement of the coating weight on the resultant steel sheet, the results of which are shown in the Table (1) Bonding strength Two pieces of the treated sample were prepared. One piece of the treated sample was baked at 210° C. for 12 minutes, after coating with 60 mg/dm$^2$ of an epoxy-phenolic type lacquer and the other piece was baked under the same conditions as described above after coating with 25 mg/dm$^2$ of the same lacquer.

The two differently coated sample pieces were each cut to a size of 5 mm×100 mm and bonded together using a nylon adhesive having a thickness of 100 μm at 200° C. for 30 seconds under 3 kg/cm of pressure by a hot press after preheating at 200° C. for 120 seconds. The bonding strength of the assembly which is shown as kg/5 mm was measured by a conventional tensile testing machine.

(2) Bonding strength after aging in hot water

The assembly prepared by the method described in (1) above, peeled by a conventional tensile testing machine after the assembly was immersed in a 0.4% citric acid solution at 90° C. for 3 days. The bonding strength of the assembly was shown as kg/5 mm.

(3) Lacquer adhesion after forming

The treated sample was baked at 210° C. for 12 minutes after coating with 50 mg/dm$^2$ of an epoxy-phenolic type lacquer. The coated sample was cut into a circular blank having a diameter of 80 mm by a punch press, and the blank was deeply drawn to form a cup at a drawing ratio of 2.0. The lacquer film on the bottom of the cup was cut crosswise with a razor, and an attempt was made to peel the lacquer film from the side and bottom of the cup with an adhesion tape.

(4) Corrosion resistance against an acidic solution after forming

The sample coated and baked as described in (3) above was cut to a size of 15 mm×100 mm. The test piece was prebent to form a V-shaped article, and was then further bent to 180° by the drop of a 3 kg weight from a height of 150 mm after placing a steel sheet having a thickness of 0.28 mm between the two sides of the prebent test piece. The bent test piece was sealed by paraffin, except for the formed part of the bent test piece, and was then immersed in 300 ml of a 0.01 mole/l phosphoric acid solution at room temperature for one week. The same procedure was repeated for another test piece, except a 0.01 mole/l citric acid solution was used containing 0.3% by weight of sodium chloride. The iron pick-up in each solution was measured and the change in the surface appearance of each test piece was evaluated with the naked eye.

(5) Weldability

The treated sample was cut to a size of 20 mm×50 mm. Two pieces of the cut sample was overlapped with each other by 20 mm in a longitudinal direction, and then welded in the center of the overlapped part by the spot welding machine (produced by Osaka transformer Co., Ltd. Model MS-100) under the following conditions:

Conditions of spot welding

Primary voltage: 140 Volt
Primary current: 20 Ampere
Voltage for welding: 0.45 Volt
Time for welding: 0.5 seconds
Diameter of electrode (made of chromium-copper): 3 mm
Pressure: 10 kg The tensile shearing strength of the welded sample was measured.

As apparent from the Table, the steel sheet having an extremely thin tin layer or an extremely thin iron-tin alloy layer obtained by using the electrolyte according to the present invention has excellent characteristics, particularly bonding strength after aging in hot water.

TABLE

Characteristics of Treated Steel Sheets

| | | | Example 1 | Example 2 | Example 3 | Example 4 |
|---|---|---|---|---|---|---|
| Tin plating | Total tin coating weight in g/m² | | 0.34 | 0.34 | 0.26 | 0.26 |
| | Amount of $FeSn_2$ (as Sn) in g/m² | | 0 | 0.32 | 0 | 0.24 |
| Electrolytic chromic acid treatment | Amount of hydrated Cr oxide (as Cr) in g/m² | | 0.012 | 0.013 | 0.015 | 0.014 |
| | Amount of metallic Cr in g/m² | | 0.002 | 0 | 0.001 | 0 |
| Bonding strength in kg/5 mm | | | 6.4 | 6.7 | 6.5 | 6.9 |
| Bonding strength after aging in hot water in kg/5 mm | | | 2.7 | 2.9 | 2.6 | 3.0 |
| Lacquer adhesion | | | No adhesion loss on bottom or side of drawn cup | No adhesion loss on bottom or side of drawn cup | No adhesion loss on bottom or side of drawn cup | No adhesion loss on bottom or side of drawn cup |
| Corrosion resistance after forming | 0.01 mole/l $H_3PO_4$ | Appearance | Slight surface corrosion | Slight surface corrosion | Slight surface corrosion | Slight surface corrosion |
| | | Dissolved Fe in ppm | 0.21 | 0.25 | 0.24 | 0.28 |
| | 0.01 mole/l citric acid | Appearance | Slight pitting | Slight pitting | Slight pitting | Slight pitting |
| | | Dissolved Fe in ppm | 0.26 | 0.23 | 0.31 | 0.30 |
| Weldability in kg | | | 75.6 | 74.1 | 76.0 | 77.2 |
| Total evaluation | | | Good | Good | Good | Good |

| | | | Example 5 | Example 6 | Comparative Example 1 | Comparative Example 2 | Comparative Example 3 |
|---|---|---|---|---|---|---|---|
| Tin plating | Total tin coating weight in g/m² | | 0.52 | 0.52 | 0.34 | 0.34 | |
| | Amount of $FeSn_2$ (as Sn) in g/m² | | 0 | 0.47 | 0 | 0.31 | |
| Electrolytic chromic acid treatment | Amount of hydrated Cr oxide (as Cr) in g/m² | | 0.011 | 0.011 | 0.012 | 0.013 | 0.019 |
| | Amount of metallic Cr in g/m² | | 0.002 | 0.002 | 0.002 | 0.001 | 0.107 |
| Bonding strength in kg/5 mm | | | 6.1 | 6.2 | 4.1 | 5.6 | 6.5 |
| Bonding strength after aging in hot water in kg/5 mm | | | 1.9 | 2.1 | 0 | 0 | 1.5 |
| Lacquer adhesion | | | No adhesion loss on bottom or side of drawn cup | No adhesion loss on bottom or side of drawn cup | Slight peeling off on bottom; no adhesion loss on side of drawn cup | No adhesion loss on bottom or side of drawn cup | No adhesion loss on bottom or side of drawn cup |
| Corrosion resistance after forming | 0.01 mole/l $H_3PO_4$ | Appearance | Slight surface corrosion | Slight surface corrosion | Slight surface corrosion | Slight surface corrosion | Substantial pitting |
| | | Dissolved Fe in ppm | 0.11 | 0.18 | 0.29 | 0.26 | 0.88 |
| | 0.01 mole/l | Appearance | Slight pitting | Slight pitting | Slight pitting | Slight pitting | Substantial |

TABLE-continued

| Characteristics of Treated Steel Sheets | | | | | |
|---|---|---|---|---|---|
| citric acid | | | | | pitting |
| Dissolved Fe in ppm | 0.19 | 0.16 | 0.35 | 0.31 | 1.19 |
| Weldability in kg | 72.4 | 73.7 | 69.3 | 70.9 | 66.5 |
| Total evaluation | Good | Good | Fair | Fair | Fair |

We claim:

1. A process for producing a steel sheet having 0.05–0.60 g/m$^2$ of metallic tin on said steel sheet which comprises electro-tinplating a steel sheet with an aqueous electrolyte consisting essentially of 5–150 g/l of at least one sulfate selected from the group of sulfates of alkaline metals, ammonium, aluminum, manganese or chromium in a stannous sulfate electrolyte or stannous phenolsulfonate electrolyte consisting of 1.5–50 g/l of stannous ions, 1.0–30 g/l of sulfuric acid or 3.6–106.5 g/l of phenolsulfonic acid, and 1–3 g/l of ethoxylated α-naphthol sulfonic acid and wherein the ratio of said stannous ions to said sulfuric acid or said phenolsulfonic acid is 1–3:1 or 1–3:3.6, respectively.

2. A process for producing a steel sheet having an iron-tin alloy on the surface thereof in which 0.05–1.0 g/m$^2$ of tin calculated from said iron-tin alloy is present on said steel sheet which comprises electro-tinplating a steel sheet with an aqueous electrolyte consisting essentially of 5–150 g/l of at least one sulfate selected from the group of sulfates of alkaline metals, ammonium, aluminum, manganese and chromium in a stannous sulfate electrolyte or stannous phenolsulfonate electrolyte consisting of 1.5–50 g/l of stannous ions, 1.0–30 g/l of sulfuric acid or 3.6–106.5 g/l of phenolsulfonic acid, and 1–3 g/l of ethoxylated α-naphthol sulfonic acid and wherein the ratio of said stannous ions to said sulfuric acid or said phenolsulfonic acid is 1–3:1 or 1–3:3.6, respectively, and heating said tin-plated steel sheet at a temperature of 232°–400° C. for 0.5–10 seconds.

3. In a process for producing an electrotinplate in which excellent corrosion resistance is required which comprises preplating a steel sheet with tin followed by a conventional tinplating step, the improvement which comprises preplating a steel sheet by using an aqueous electrolyte containing 5–150 g/l of at least one sulfate selected from the group of sulfates of alkaline metals, ammonium, aluminum, manganese or chromium in a stannous sulfate electrolyte or stannous phenolsulfonate electrolyte consisting essentially of 1.5–50 g/l of stannous ions, 1.0–30 g/l of sulfuric acid or 3.6–106.5 g/l of phenolsulfonic acid, and 1–3 g/l of ethoxylated α-naphthol sulfonic acid and wherein the weight ratio of said stannous ions to said sulfuric acid or said phenolsulfonic acid is 1–3:1 or 1–3:3.6 at a temperature of 25° to 60° C. and under a cathodic current density of 5–50 A/dm$^2$ followed by tinplating the preplated steel sheet in a conventional tinplating step which is performed in an aqueous electrolyte consisting of 15–50 g/l of stannous ions, 10–30 g/l of sulfuric acid or 36–106.5 g/l of phenolsulfonic acid and 3–10 g/l of ethoxylated α-naphthol sulfonic acid at a temperature of 25° to 60° C. and under a cathodic current density of 5–50 A/dm$^2$.

* * * * *